US006920809B2

(12) United States Patent
Chen

(10) Patent No.: US 6,920,809 B2
(45) Date of Patent: Jul. 26, 2005

(54) SELECTIVE ONE-WAY WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/760,525

(22) Filed: Jan. 21, 2004

(65) Prior Publication Data

US 2005/0103166 A1 May 19, 2005

(30) Foreign Application Priority Data

Nov. 19, 2003 (TW) ..... 92132386

(51) Int. Cl.[7] ..... B25B 13/46
(52) U.S. Cl. ..... 81/63.2; 192/43.2
(58) Field of Search ..... 81/63, 63.2; 192/43.2

(56) References Cited

U.S. PATENT DOCUMENTS

2003/0196522 A1 * 10/2003 Hu ..... 81/63.2

* cited by examiner

*Primary Examiner*—James G. Smith
(74) *Attorney, Agent, or Firm*—Birch, Stewart, Kolasch & Birch, LLP

(57) ABSTRACT

A selective one-way wrench includes an annular head, a gear, a pawl, a transmission and a switch. The annular head defines a first space, a second space communicated with the first space and an aperture communicated with the second space. The gear is rotationally put in the first space. The gear includes a toothed face. The pawl is put in the second space. The pawl includes a toothed side for engagement with the toothed face of the gear. The transmission is rotationally put in the second space. The transmission includes three protrusions selective one of which is put between the rods of the pawl so that the transmission can move the pawl. The switch is put into the second space through the aperture for connection with the transmission.

20 Claims, 9 Drawing Sheets

SELECTIVE ONE-WAY WRENCH

This Nonprovisional application claims priority under 35 U.S.C. § 119(a) on patent application No(s). 92132386 filed in TAIWAN on Nov. 19, 2003, the entire contents of which are hereby incorporated by reference.

FIELD OF INVENTION

The present invention relates to a selective one-way wrench.

BACKGROUND OF INVENTION

Referring to FIG. 10, a conventional selective one-way wrench 110 includes a handle 114, an annular head 115, an annular gear 120, a pawl 130 and a switch 140. The annular head 115 is formed at an end of the handle 114, the annular head 115 defines a first space 111, a second space 112 communicated with the first space 111 and a third space 113 communicated with the second space 112. The annular gear 120 is rotationally put in the first space 111. The annular gear 120 includes a toothed external face 121 formed thereon and a toothed internal face 122 for engagement with a bolt or nut. The pawl 130 is put in the second space 112. The pawl 130 includes a toothed side 131 formed thereon. The switch 140 is rotationally put in the third space 113 of the handle 114 and partially put in the second space 112 for bringing the toothed side 131 of the pawl 130 into engagement with the toothed external face 121 of the annular gear 120.

SUMMARY OF INVENTION

The primary objective of the present invention is to provide a selective one-way wrench.

A selective one-way wrench includes an annular head, a gear, a pawl, a transmission and a switch. The annular head defines a first space, a second space communicated with the first space and an aperture communicated with the second space. The gear is rotationally put in the first space. The gear includes a toothed face. The pawl is put in the second space. The pawl includes a toothed side for engagement with the toothed face of the gear. The transmission is rotationally put in the second space. The transmission includes three protrusions selective one of which is put between the rods of the pawl so that the transmission can move the pawl. The switch is put into the second space through the aperture for connection with the transmission.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
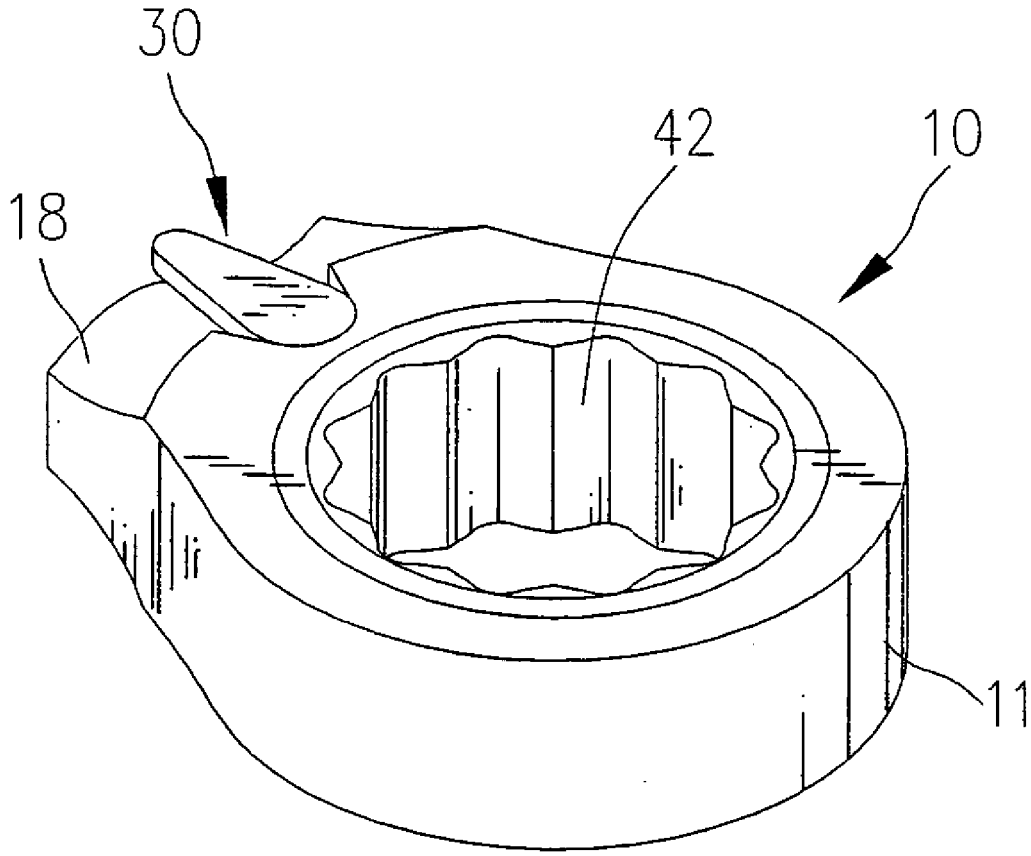
FIG. 1 is a perspective view of a selective one-way wrench according to a first embodiment of the present invention.

Referring to FIG. 1, according to a first embodiment of the present invention, a selective one-way wrench 10 includes a handle 18 and an annular head 11 from which the handle 18 projects.

Figure 2:
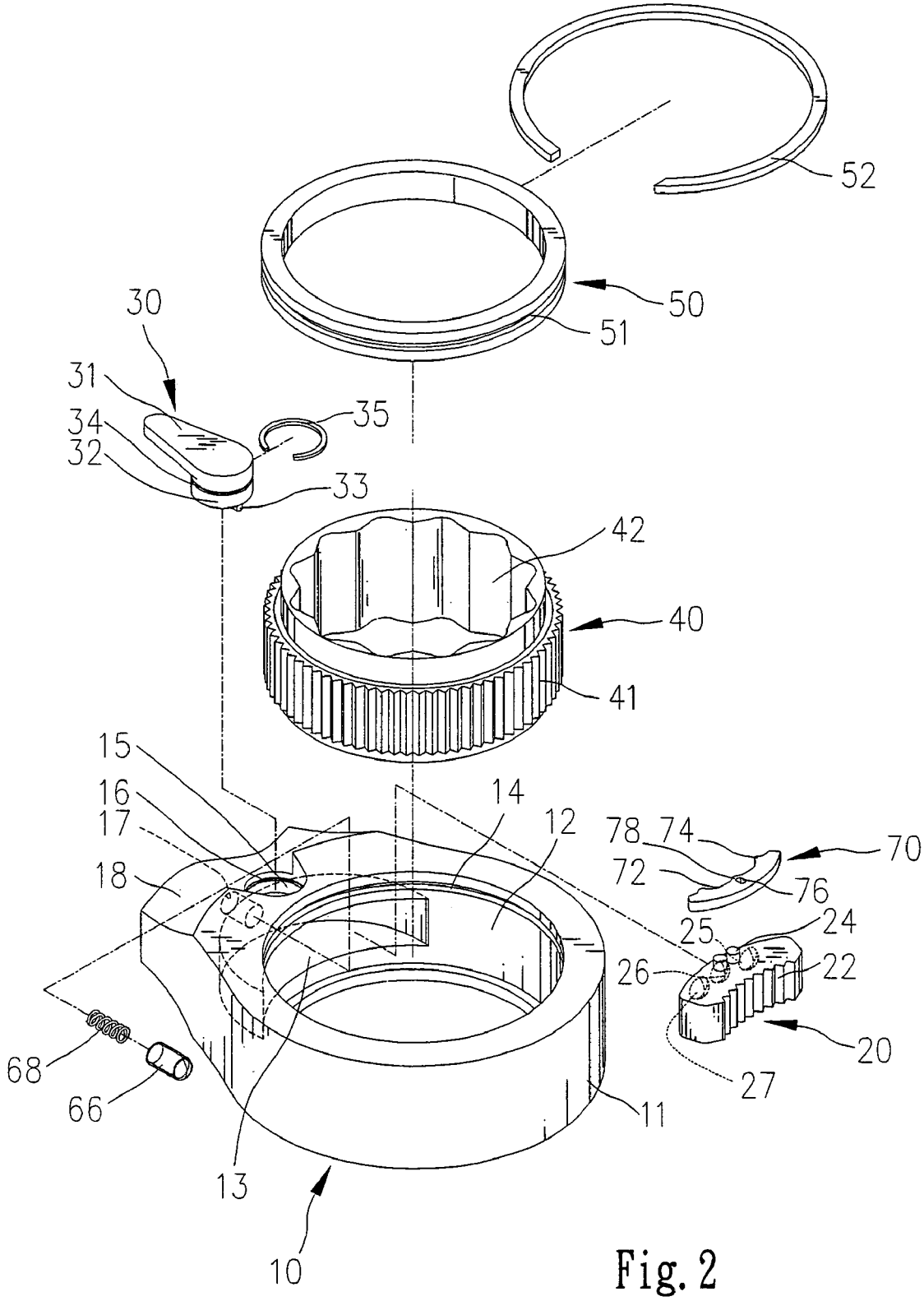
FIG. 2 is an exploded view of the selective one-way wrench shown in FIG. 1.

Referring to FIG. 2, the annular head 11 defines a circular space 12, a crescent space 13 communicated with the circular space 12 and an aperture 15 communicated with the crescent space 13. An annular groove 14 is defined in a wall of the circular space 12. A recess 17 is defined in the wall of the crescent space 13. An annular groove 16 is defined in the wall of the aperture 15.

A spring 68 and a rod detent 66 are put in the recess 17.

A pawl 20 is put in the crescent space 13. The pawl 20 includes two ends, a top, a bottom, a toothed side 22 and an arched side. Two rods 24 are formed on the top. Three recesses 25, 26 and 27 are defined in the arched side.

A transmission 70 is put in the crescent space 13 after the pawl 20. The transmission 70 includes a recess 76 defined in the top and three protrusions 72, 74 and 78 extending from a side. The protrusion 78 is located between the protrusions 72 and 74.

An annular gear 40 is put in the circular space 12. The annular gear 40 includes a toothed internal face 42 for engagement with a bolt or nut and a toothed external face 41 for engagement with the pawl 20.

The O-ring 50 is rotationally put on the annular gear 40. The O-ring 50 is put in the circular space 12. The O-ring 50 includes an annular groove 51 defined in an external face thereof. A C-ring 52 includes an internal edge put in the annular groove 51 and an external edge put in the annular groove 14. Thus, the O-ring 50 is firmly attached to the annular head 11 by means of the C-ring 52.

A switch 30 is put in the aperture 15. The switch 30 includes a lever 31, a shaft 32 extending from the lever 31, a ridge 33 extending from the shaft 32 and an annular groove 34 defined in the shaft 32. The ridge 33 is inserted into the recess 76 through the aperture 15. The switch 30 can drive the transmission 70 so that the protrusion 72 or 74 is engaged with rods 24.

A C-ring 35 includes an internal edge put in the groove 34. The C-ring 35 includes an external edge put in the annular groove 16. Thus, the switch 30 is firmly attached to the annular head 11 by means of the C-ring 35.

Figure 3:
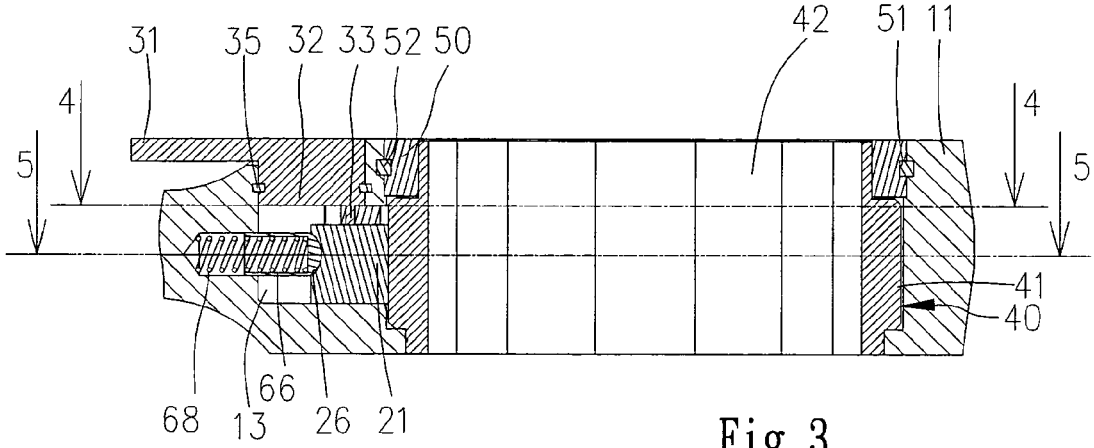
FIG. 3 is a cross-sectional view of the selective one-way wrench of FIG. 1.
Figure 4:
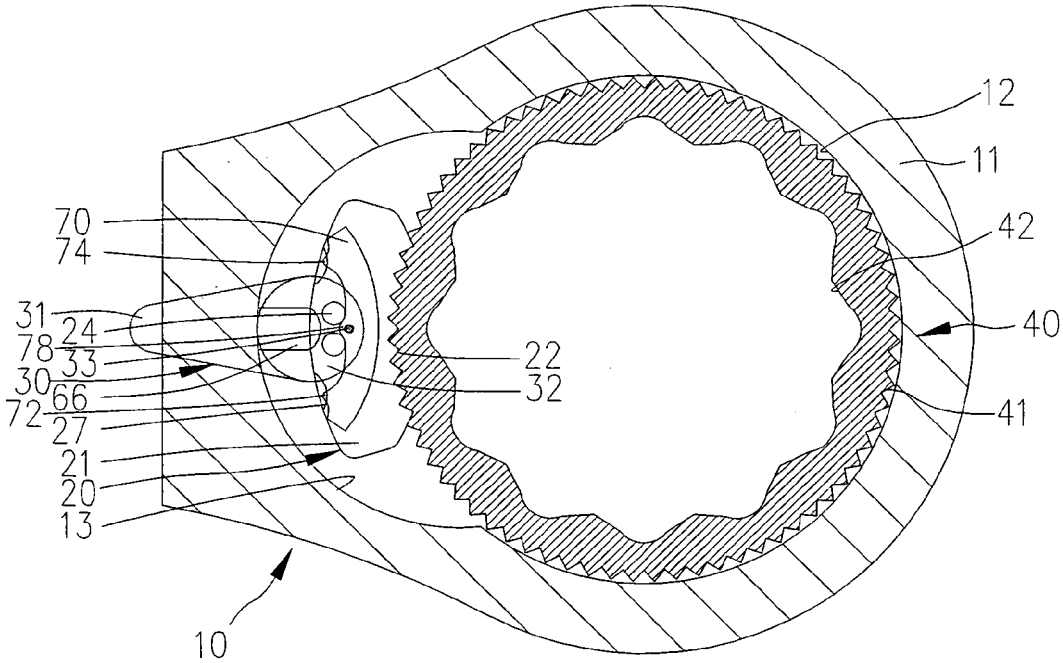
FIG. 4 is a cross-sectional view taken along a line 4—4 in FIG. 3.
Figure 5:
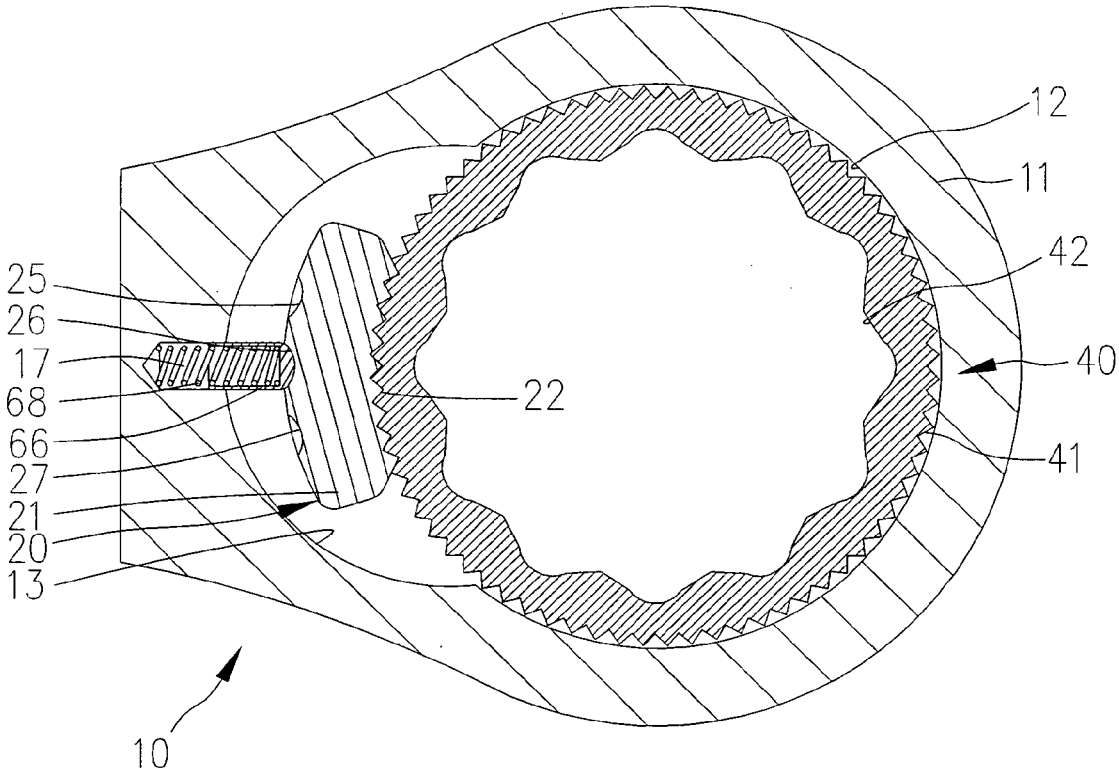
FIG. 5 is a cross-sectional view taken along a line 5—5 in FIG. 3.

Referring to FIGS. 3 to 5, the switch 30 is in a neutral mode. The protrusion 78 is put between the rods 24. The rod detent 66 is put in the recess 26 so as to keep the switch 30 in the neutral mode.

Figure 6:
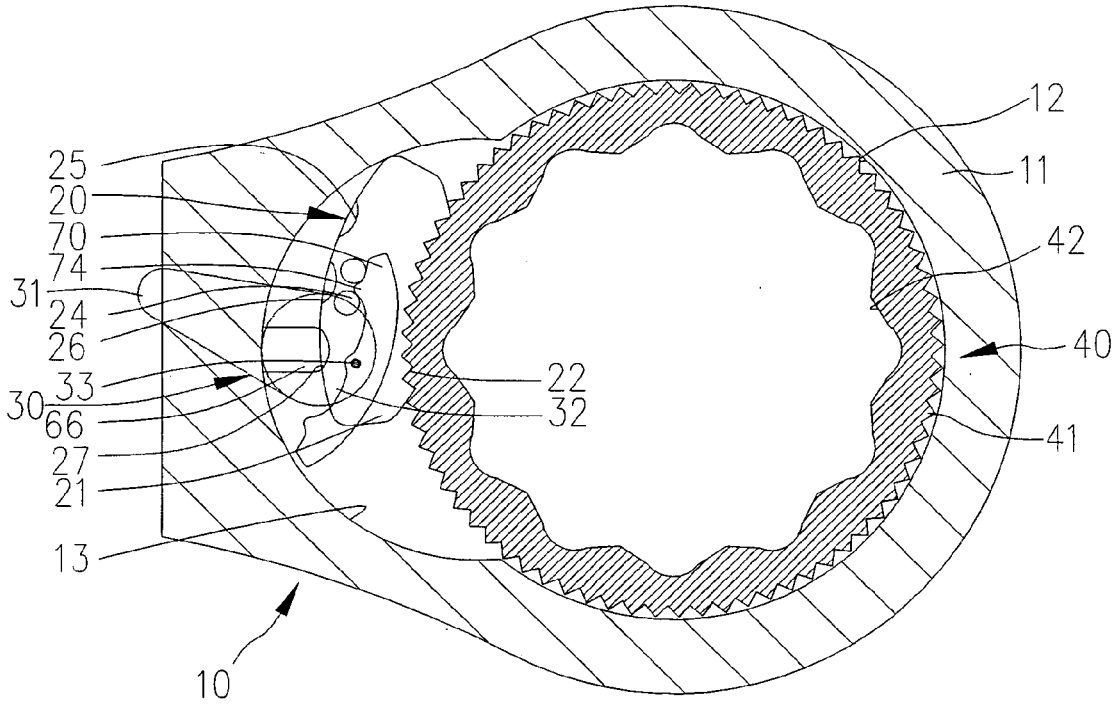
FIG. 6 is similar to FIG. 4 but shows the selective one-way wrench in a position for driving a bolt or nut counterclockwise.
Figure 7:
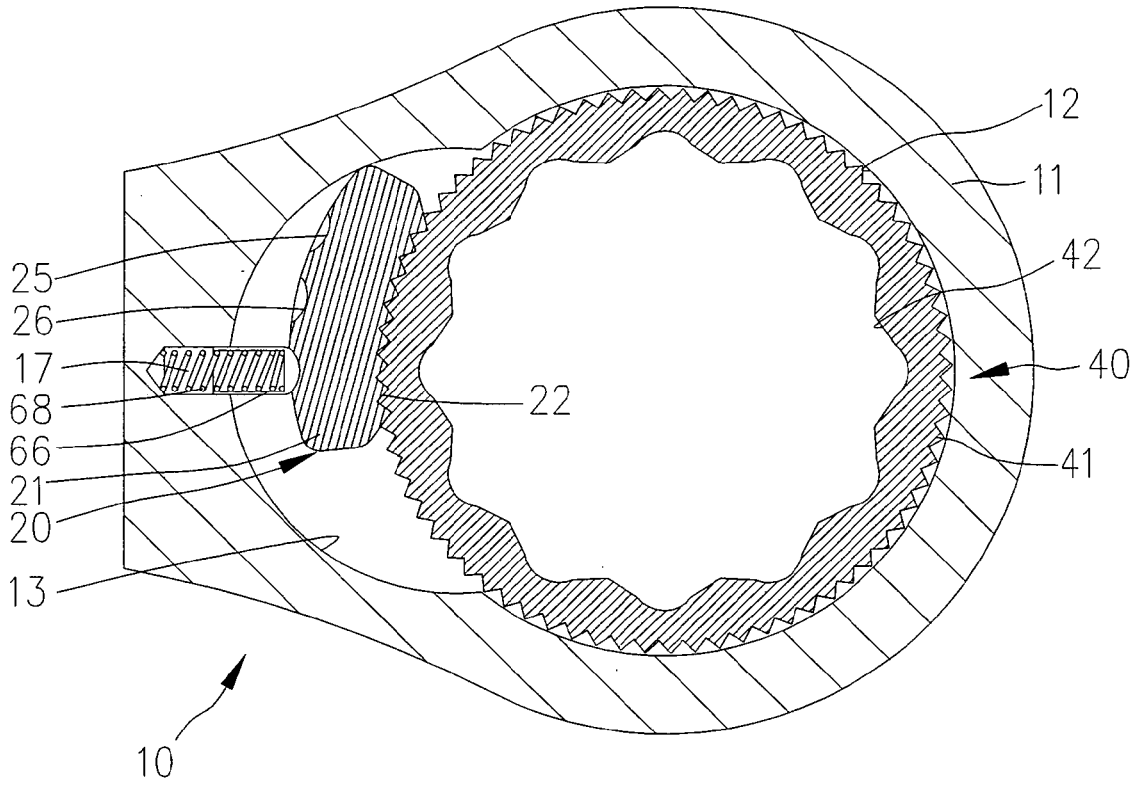
FIG. 7 is similar to FIG. 5 but shows the selective one-way wrench in a position for driving a bolt or nut counterclockwise.

Referring to FIGS. 6 and 7, the switch 30 is moved to a first working mode. The switch 30 is rotated clockwise. The transmission 70 is moved accordingly. The protrusion 78 is moved from the rods 24. Instead, the protrusion 74 is put between the rods 24. The pawl 20 is moved into a right-hand end of the crescent space 13 so that the rod dent 66 enters the recess 27. The annular head 11 can drive the annular gear 40 counterclockwise, but not vice versa.

Although not shown, the switch 30 can be moved to a second working mode. The switch 30 is rotated counterclockwise. The transmission 70 is moved accordingly. The protrusion 78 is moved from the rods 24. Instead, the protrusion 72 is put between the rods 24. The pawl 20 is moved into a left-hand end of the crescent space 13 so that the rod dent 66 enters the recess 25. The annular head 11 can drive the annular gear 40 clockwise, but not vice versa.

Figure 8:
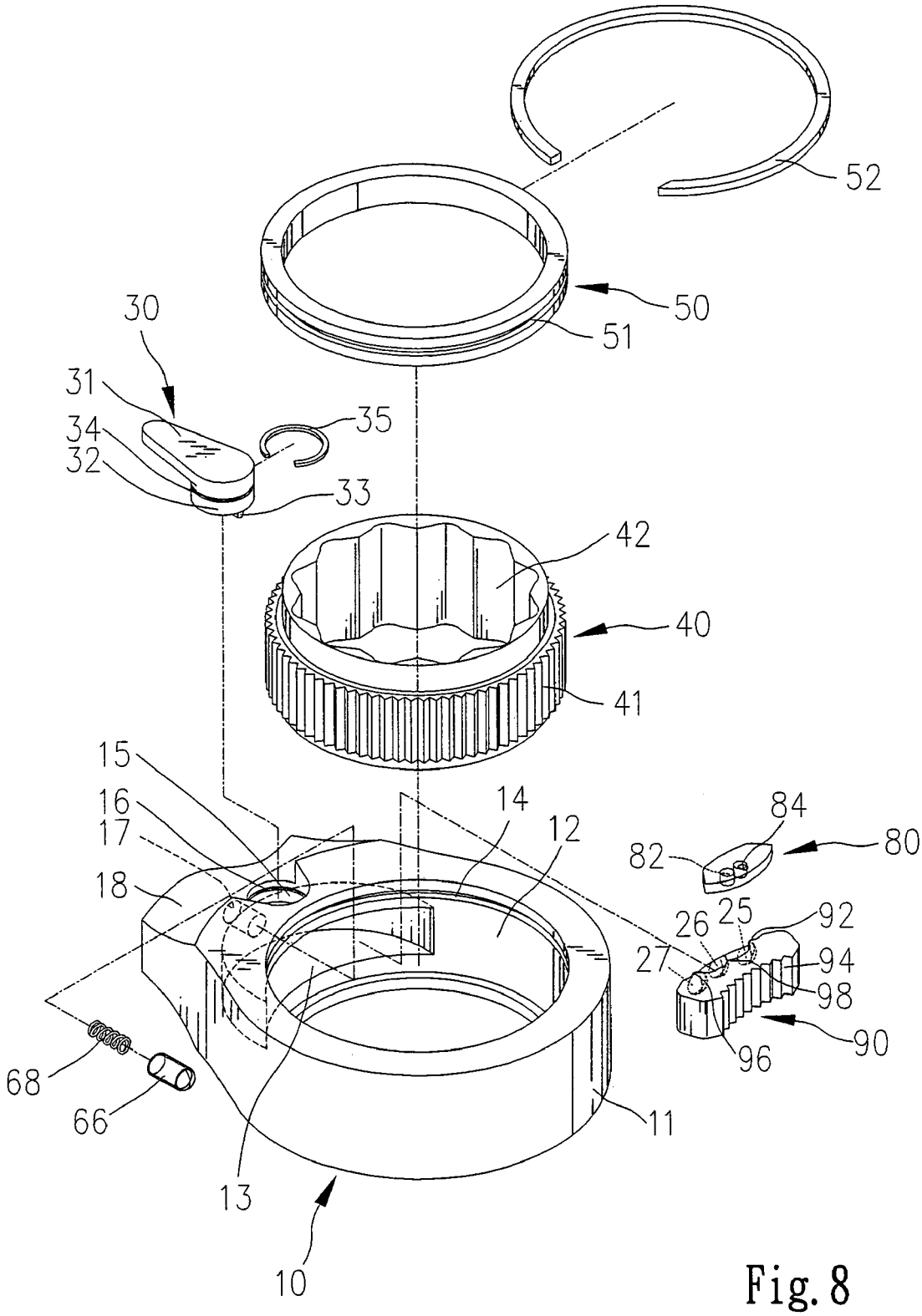
FIG. 8 is an exploded view of a selective one-way wrench according to a second embodiment of the present invention.

FIG. 8 shows a selective one-way wrench 10 according to a second embodiment of the present invention. The second embodiment is identical to the first embodiment except for including a pawl 90 instead of the pawl 20 and a transmission 80 instead of the transmission 70. The pawl 90 is identical to the pawl 20 except for including three protrusions 92, 96 and 98 on an arched side instead of the rods 24 on the top. The transmission 80 is identical to the transmission 70 except for including two rods 82 on a bottom instead of the protrusions 72, 74 and 78 on the side.

Figure 9:
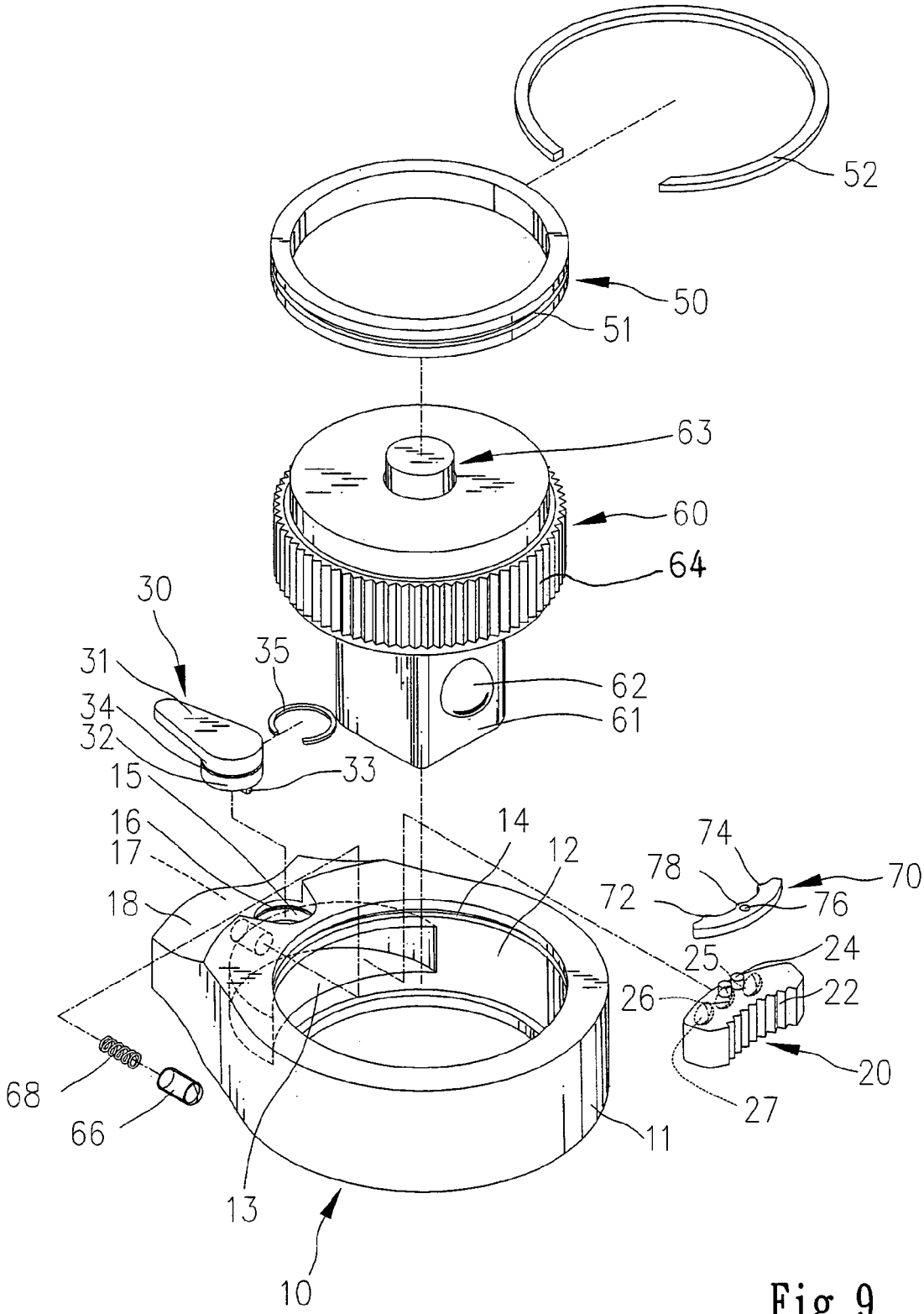
FIG. 9 is an exploded view of a selective one-way wrench according to a third embodiment of the present invention.
Figure 10:
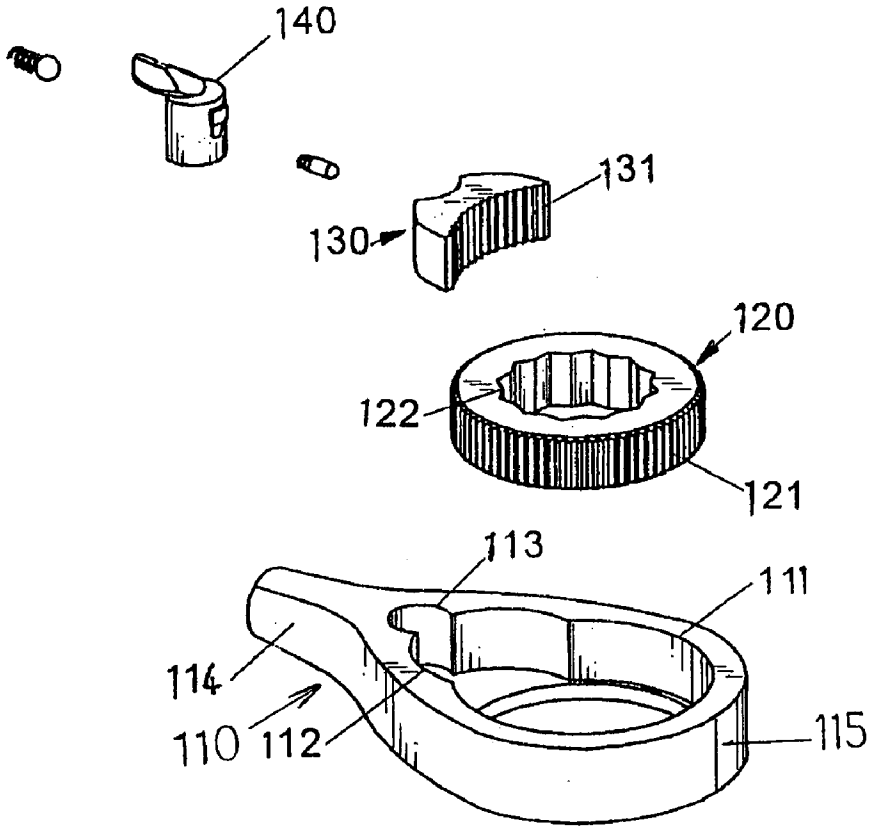
Fig. 10 PRIOR ART
FIG. 10 is an exploded view of a conventional selective one-way wrench.

FIG. 9 shows a selective one-way wrench 10 according to a third embodiment of the present invention. The third embodiment is identical to the first embodiment except for replacing the annular gear 40 with a joint 60. The joint 60 includes a hollow insert 61, a detent 62 movably put in the hollow insert 61 and a control element 63 movably put in the hollow insert 61 for pushing the detent 62 from the hollow insert 61.

The present invention has been described-through detailed illustration of three embodiments. Those skilled in the art can derive variation from the embodiments without departing from the scope of the present invention. Therefore, the embodiments shall not limit the scope of the present invention defined in the claims.

What is claimed is:

1. A selective one-way wrench comprising:

an annular head defining a first space, a second space communicated with the first space and an aperture communicated with the second space;

a gear rotationally put in the first space, the gear including a toothed face;

a pawl put in the second space, the pawl including a toothed side engaged with the toothed face of the gear and two rods formed on a top;

a transmission rotationally put in the second space, the transmission including three protrusions selective one of which is put between the rods of the pawl so that the transmission can move the pawl; and a switch put into the second space through the aperture for connection with the transmission.

2. The selective one-way wrench according to claim 1 wherein the switch includes a lever that is operable for the rotation thereof.

3. The selective one-way wrench according to claim 1 wherein the switch includes a shaft extending into the second space through the aperture for connection with the transmission.

4. The selective one-way wrench according to claim 3 wherein the switch further includes a ridge extending from the shaft, and the transmission defines a recess for receiving the ridge.

5. The selective one-way wrench according to claim 1 including a detent arranged between the wall of the second space and the pawl, wherein the pawl defines three recesses selective one of which receives the detent so as to keep the pawl in position relative to the detent.

6. The selective one-way wrench according to claim 5 wherein the detent is a spring-biased detent.

7. The selective one-way wrench according to claim 1 including a C-ring, wherein the switch defines an annular groove in an external side for receiving an internal edge of the C-ring, and the annular head defines an annular groove in a wall of the aperture for receiving an external edge of the C-ring.

8. The selective one-way wrench according to claim 1 wherein the gear is an annular gear.

9. The selective one-way wrench according to claim 1 wherein the gear includes an insert for insertion in and rotation of a socket.

10. The selective one-way wrench according to claim 1 including a handle projecting from the annular head.

11. A selective one-way wrench comprising:

the annular head defining a first space, a second space communicated with the first space and an aperture communicated with the second space;

a gear rotationally put in the first space, the gear including a toothed face;

a pawl put in the second space, the pawl including a toothed side engaged with the toothed face of the gear and three protrusions formed on a side;

a transmission put rotationally in the second space, the transmission including two rods for restricting selective one of the protrusions of the pawl so that the transmission can move the pawl; and a switch put into the second space through the aperture for connection with the transmissions.

12. The selective one-way wrench according to claim 11 wherein the switch includes a lever that is operable for the rotation thereof.

13. The selective one-way wrench according to claim 11 wherein the switch includes a shaft extending into the second space through the aperture for connection with the transmission.

14. The selective one-way wrench according to claim 13 wherein the switch further includes a ridge extending from the shaft, and the transmission defines a recess for receiving the ridge.

15. The selective one-way wrench according to claim 11 including a detent arranged between the wall of the second space and the pawl, wherein the pawl defines three recesses selective one of which receives the detent so as to keep the pawl in position relative to the detent.

16. The selective one-way wrench according to claim 15 wherein the detent is a spring-biased detent.

17. The selective one-way wrench according to claim 11 including a C-ring, wherein the switch defines an annular groove in an external side for receiving an internal edge of the C-ring, and the annular head defines an annular groove in a wall of the aperture for receiving an external edge of the C-ring.

18. The selective one-way wrench according to claim 11 wherein the gear is an annular gear.

19. The selective one-way wrench according to claim 11 wherein the gear includes an insert for insertion in and rotation of a socket.

20. The selective one-way wrench according to claim 11 including a handle projecting from the annular head.

* * * * *